US011837835B2

(12) United States Patent
Kerstetter et al.

(10) Patent No.: US 11,837,835 B2
(45) Date of Patent: Dec. 5, 2023

(54) TERMINAL FEEDING ASSEMBLY OF A CRIMPING MACHINE

(71) Applicant: TE Connectivity Services GmbH, Schaffhausen (CH)

(72) Inventors: Chadwick Alan Kerstetter, Middletown, PA (US); Todd Matthew Troutman, Middletown, PA (US)

(73) Assignee: TE Connectivity Solutions GmbH, Schaffhausen (CH)

( * ) Notice: Subject to any disclaimer, the term of this patent is extended or adjusted under 35 U.S.C. 154(b) by 42 days.

(21) Appl. No.: 17/230,388

(22) Filed: Apr. 14, 2021

(65) Prior Publication Data

US 2022/0337011 A1 Oct. 20, 2022

(51) Int. Cl.
*H01R 43/055* (2006.01)

(52) U.S. Cl.
CPC ..... *H01R 43/055* (2013.01); *Y10T 29/53235* (2015.01)

(58) Field of Classification Search
CPC ..... H01R 43/048; H01R 43/055; H01R 43/0421; H01R 43/00; H01R 43/04; Y10T 29/5193; Y10T 29/53235; Y10T 29/53213; Y10T 29/49185; Y10T 29/5142; Y10T 29/53209; Y10T 29/53161; H02K 15/0068; H02K 15/0056
USPC .... 29/753, 33 M, 566.2, 747, 748, 751, 759, 29/857, 863, 876, 884
See application file for complete search history.

(56) References Cited

U.S. PATENT DOCUMENTS 6,367,148 B1 * 4/2002 Caveney ..... H01R 43/055 29/748
10,686,287 B2 * 6/2020 Weaver ..... H01R 43/048

FOREIGN PATENT DOCUMENTS

CN 108233148 A 6/2018
CN 110265848 A 9/2019
CN 110661151 B 2/2021

OTHER PUBLICATIONS

International Search Report, International App. No. PCT/IB2022/0535431 International Filing Date Apr. 14, 2022.

* cited by examiner

*Primary Examiner* — Thiem D Phan

(57) ABSTRACT

A terminal feeding assembly includes a translation device having a guide track, a terminal gripper movable along the guide track, and a translation drive connected to the terminal gripper. The translation drive moves the terminal gripper along the guide track from a gripping position outside of a crimping area of a crimping assembly to a crimping position in the crimping area while the terminal gripper grips a terminal.

17 Claims, 10 Drawing Sheets

TERMINAL FEEDING ASSEMBLY OF A CRIMPING MACHINE

FIELD OF THE INVENTION

The present invention relates to a crimping machine and, more particularly, to a terminal feeding assembly of a crimping machine.

BACKGROUND

A crimping machine crimps a terminal to an end of a conductor of a wire. The crimping machine commonly requires an operator to manually load or insert each terminal into a crimping area of the crimping machine prior to crimping. If the terminal is one a plurality of terminals connected to a strip, the terminal is separated from the strip during the crimp in the crimping area.

The manual loading process requires the operator to remain with the crimping machine throughout the crimping, loading each terminal into the machine at the necessary time. The manual operator involvement and intervention required for the crimping of each terminal is inefficient both in consuming the operator's attention and in lengthening the overall time needed to crimp all of the terminals. Further, the operator's manual interaction with the crimping area poses a risk of operator injury.

SUMMARY

A terminal feeding assembly includes a translation device having a guide track, a terminal gripper movable along the guide track, and a translation drive connected to the terminal gripper. The translation drive moves the terminal gripper along the guide track from a gripping position outside of a crimping area of a crimping assembly to a crimping position in the crimping area while the terminal gripper grips a terminal.

BRIEF DESCRIPTION OF THE DRAWINGS

The invention will now be described by way of example with reference to the accompanying Figures, of which.

DETAILED DESCRIPTION OF THE EMBODIMENTS

Figure 1:
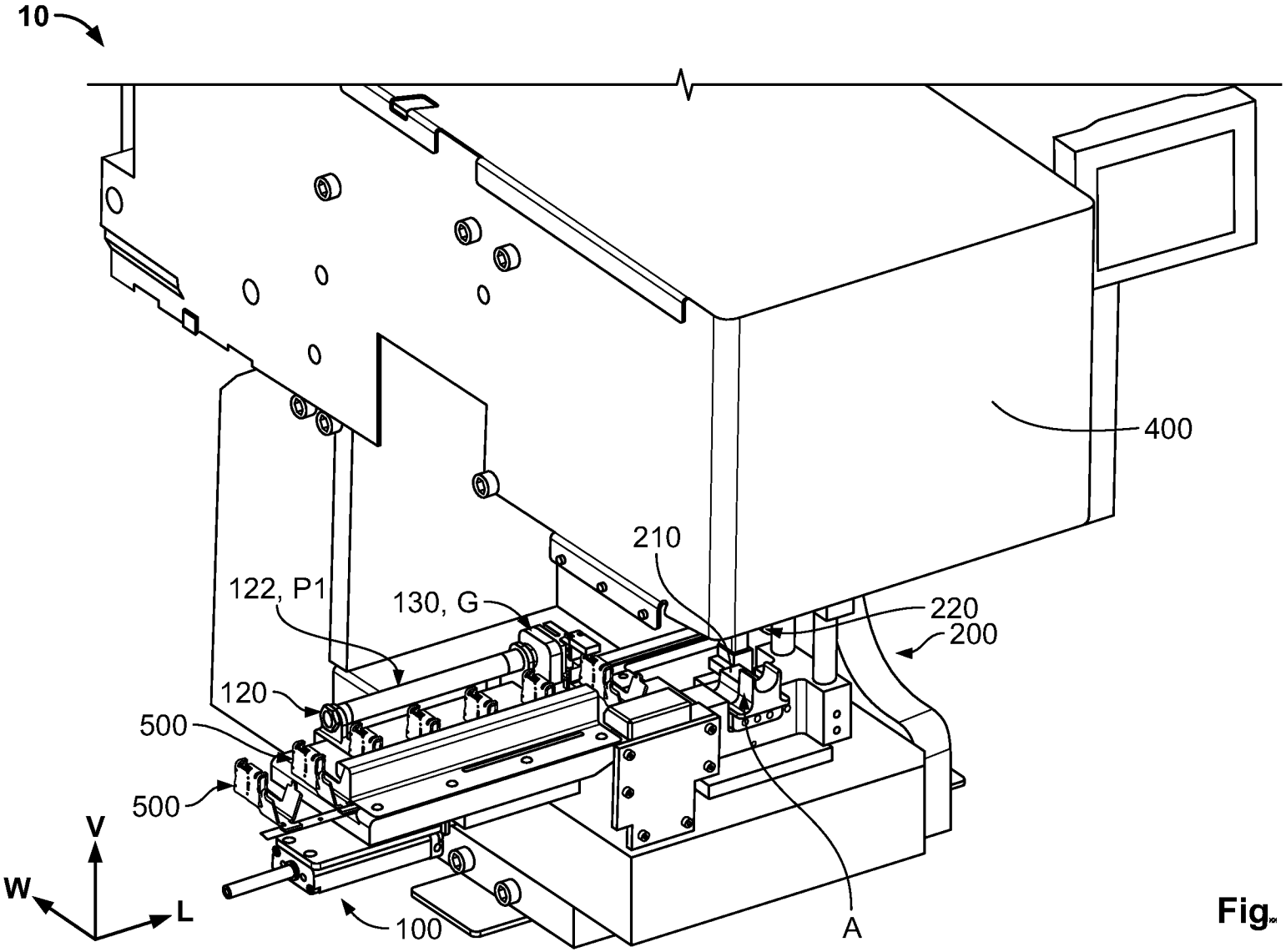
FIG. 1 is a perspective view of a crimping machine according to an embodiment.

Exemplary embodiments of the present disclosure will be described hereinafter in detail with reference to the attached drawings, wherein like reference numerals refer to like elements. The present disclosure may, however, be embodied in many different forms and should not be construed as being limited to the embodiments set forth herein; rather, these embodiments are provided so that the present disclosure will convey the concept of the disclosure to those skilled in the art. In addition, in the following detailed description, for purposes of explanation, numerous specific details are set forth in order to provide a thorough understanding of the disclosed embodiments. However, it is apparent that one or more embodiments may also be implemented without these specific details.

A crimping machine 10 according to an embodiment, as shown in FIG. 1, comprises a terminal feeding assembly 100, a crimping assembly 200 connected to the terminal feeding assembly 100, and a controller 400 connected to and controlling the terminal feeding assembly 100 and the crimping assembly 200.

Figure 2:
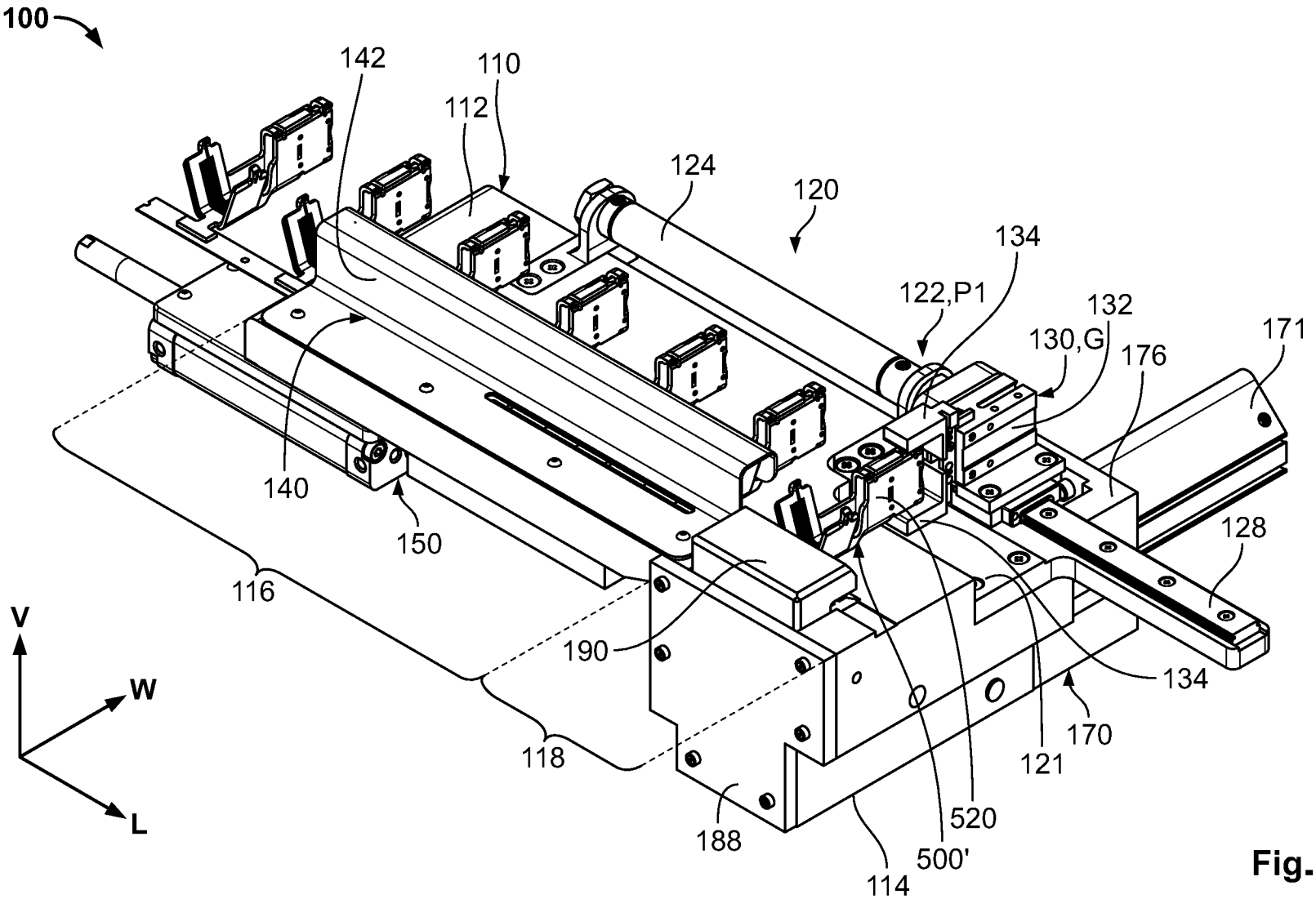
FIG. 2 is a perspective view of a terminal feeding assembly of the crimping machine.
Figure 3:
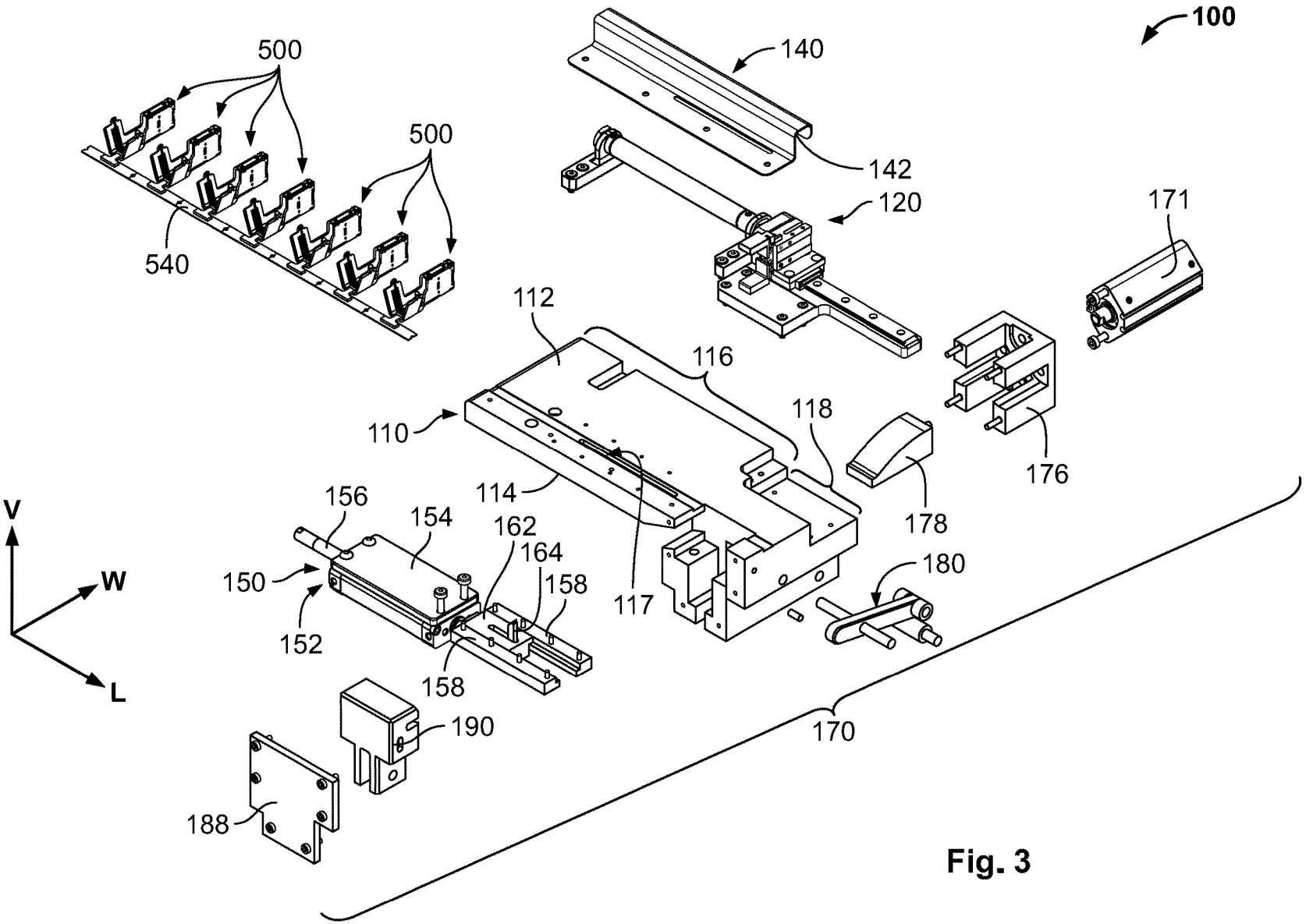
FIG. 3 is an exploded perspective view of the terminal feeding assembly.

The terminal feeding assembly 100, as shown in the embodiment of FIGS. 2 and 3, includes a base 110, a translation device 120 disposed on the base 110, a guide cover 140 disposed on the base 110, a strip feed assembly 150 attached to the base 110, and a shear assembly 170 attached to the base 110.

Figure 4:
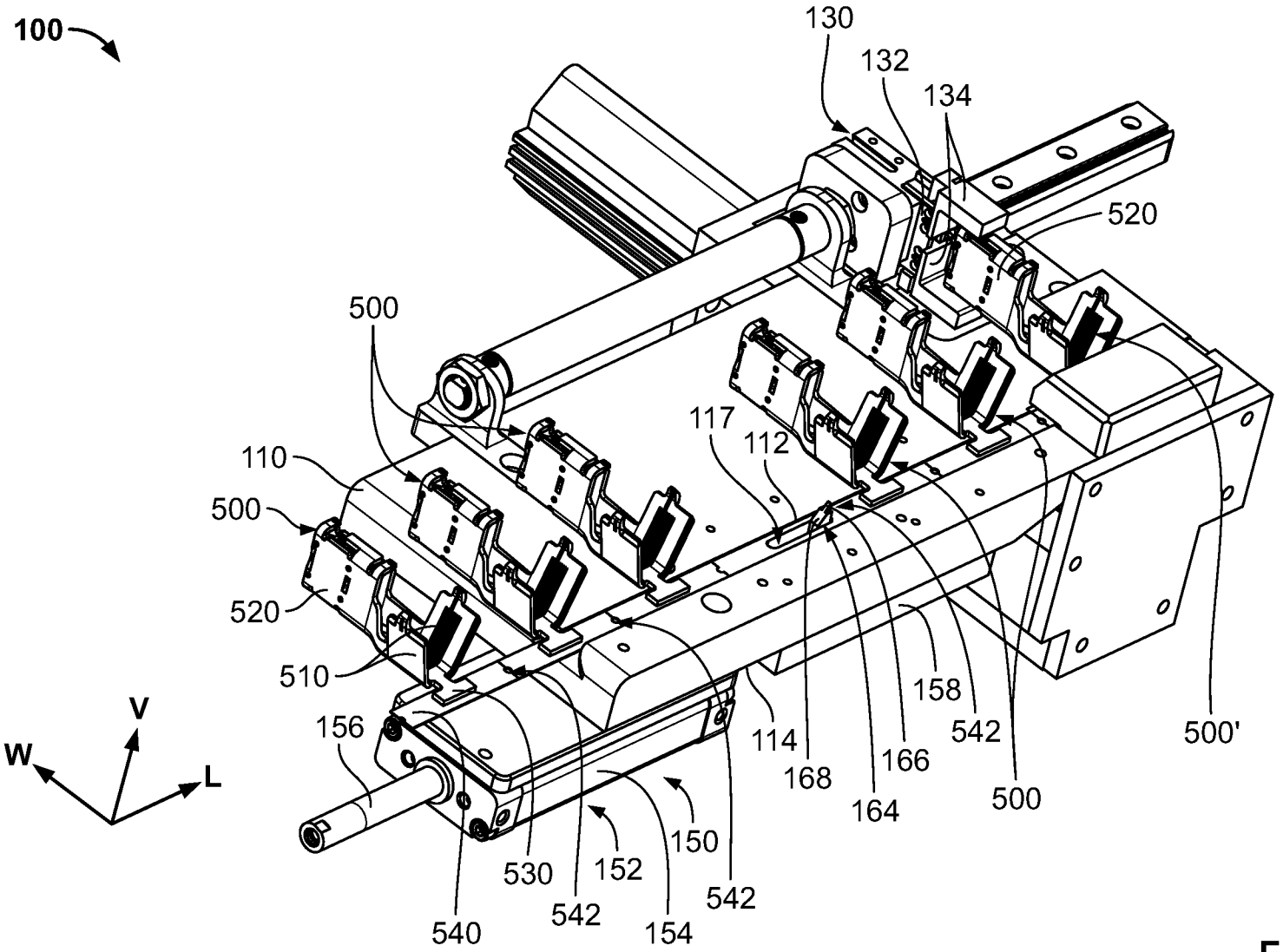
FIG. 4 is a detail perspective view of a portion of the terminal feeding assembly.

The base 110, as shown in FIGS. 2 and 3, has an upper side 112 and a lower side 114 opposite to the upper side 112 in a vertical direction V. The base 110 has a feed section 116 formed as an approximately rectangular parallelepiped shape and a shear section 118 adjacent to the feed section 116 in a longitudinal direction L perpendicular to the vertical direction V. In the feed section 116, the base 110 has a feed passageway 117 extending along the longitudinal direction L and extending through the base 110 in the vertical direction V from the upper side 112 to the lower side 114, as also shown in FIG. 4. In the shown embodiment, the base 110 is monolithically formed in a single piece. In other embodiments, the base 110 may be formed from multiple pieces and assembled together to form the feed section 116 and the shear section 118 as described herein.

The translation device 120, as shown in FIG. 2, has a translation mount 121, a translation drive 122 attached to the translation mount 121, a guide track 128 disposed on the translation mount 121, and a terminal gripper 130 attached to the translation drive 122 and the guide track 128.

Figure 6:
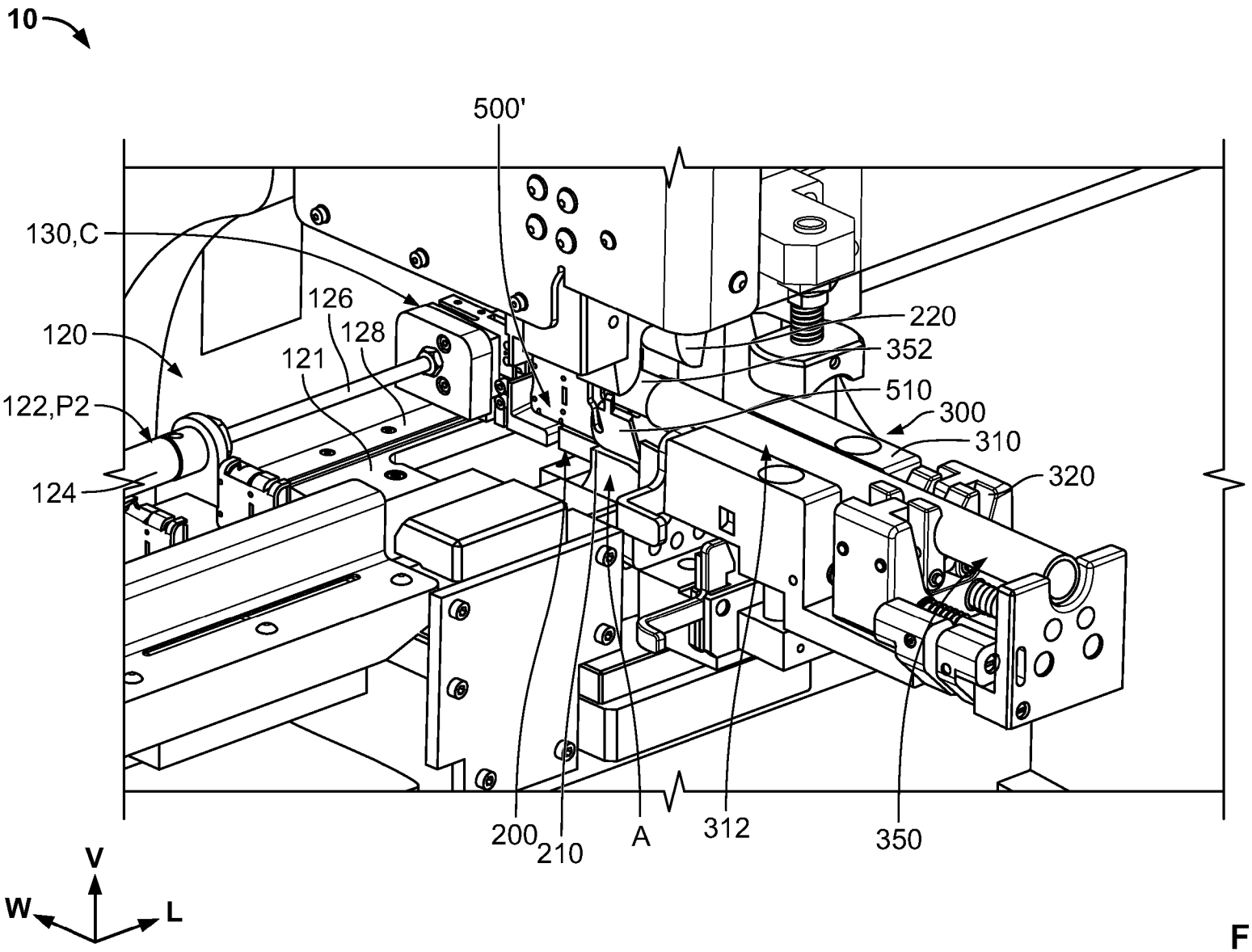
FIG. 6 is a detail perspective view of a portion of the crimping machine.

The translation drive 122, as shown in FIGS. 2 and 6, includes a translation cylinder 124 and a translation piston 126 disposed within the translation cylinder 124. The translation piston 126 is movable within the translation cylinder 124, for example under control of the controller 400 as described in greater detail below, to move the translation drive 122 along the longitudinal direction L between a retracted position P1 shown in FIGS. 1 and 2, and an extended position P2 shown in FIG. 6.

The guide track 128, as shown in FIGS. 2 and 6, is disposed on the translation mount 121 and extends along the longitudinal direction L. The guide track 128 extends from an end of the translation cylinder 124 and away from the translation cylinder 124 along the longitudinal direction L.

The terminal gripper 130, as shown in FIGS. 2 and 6, is attached to an end of the translation piston 126 and is connected to the guide track 128 to be movable along the guide track 128 in the longitudinal direction L. The terminal gripper 130, as shown in FIG. 2, has a gripper actuator 132 and a pair of arms 134 connected to the gripper actuator 132. The pair of arms 134 are movable by the gripper actuator 132 along the vertical direction V toward each other and away from each other. In an embodiment, the pair of arms 134 is one of a plurality of interchangeable pairs of arms 134 that are each interchangeably connectable to the gripper actuator 132. In an embodiment, each pair of the plurality of interchangeable pairs of arms 134 is different and each corresponds to one of a plurality of different types of terminals 500.

The translation device 120, as shown in FIG. 2, is attached to the upper side 112 of the base 110. The translation mount 121 is disposed on the upper side 112 in the shear section 118. The translation cylinder 124 is attached to the upper side 112 in the feed section 116 and the guide track 128 extends away from the shear section 118 along the longitudinal direction L.

Figure 5:
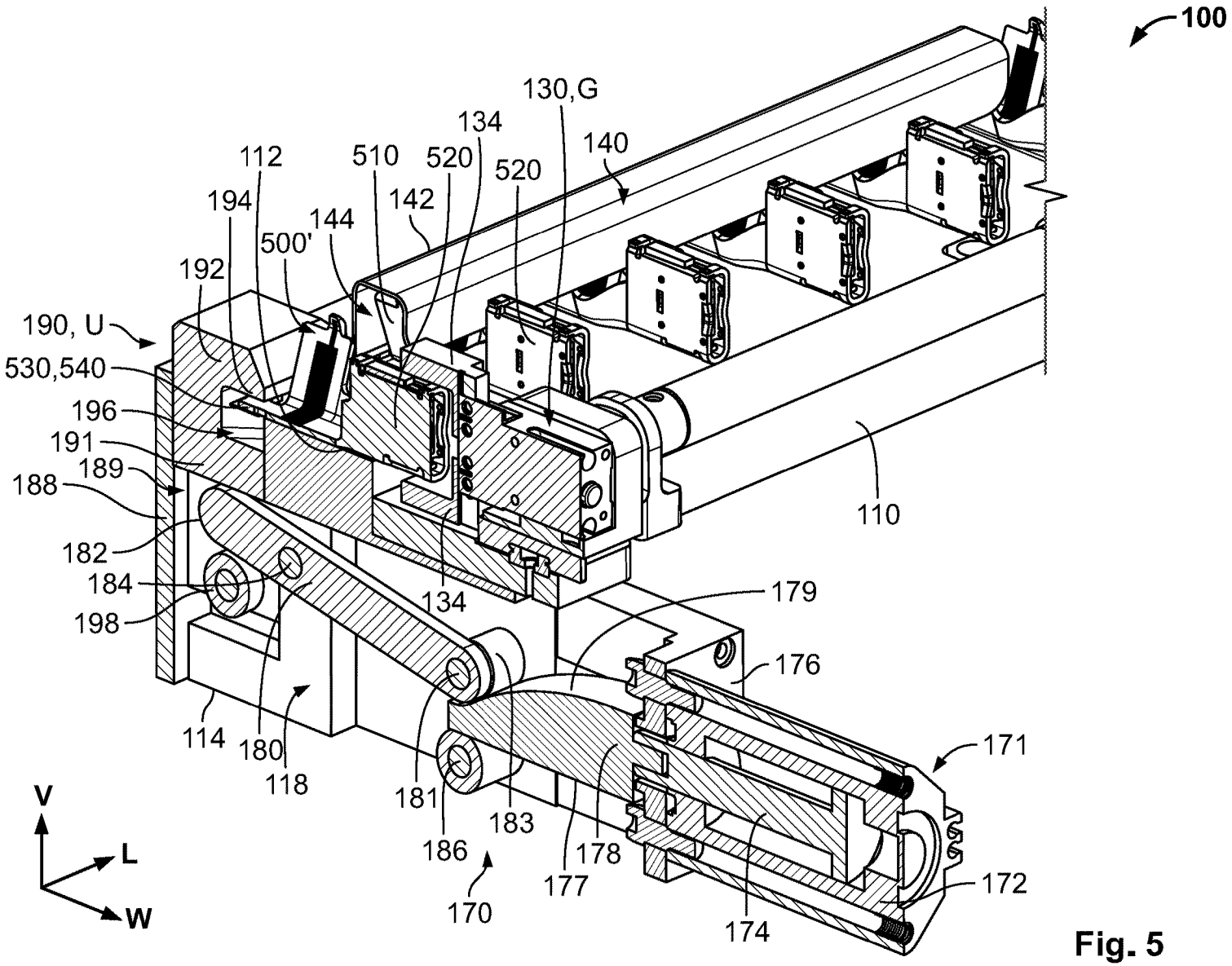
FIG. 5 is a sectional perspective view of the terminal feeding assembly with a shear element in an upper position.
Figure 8:
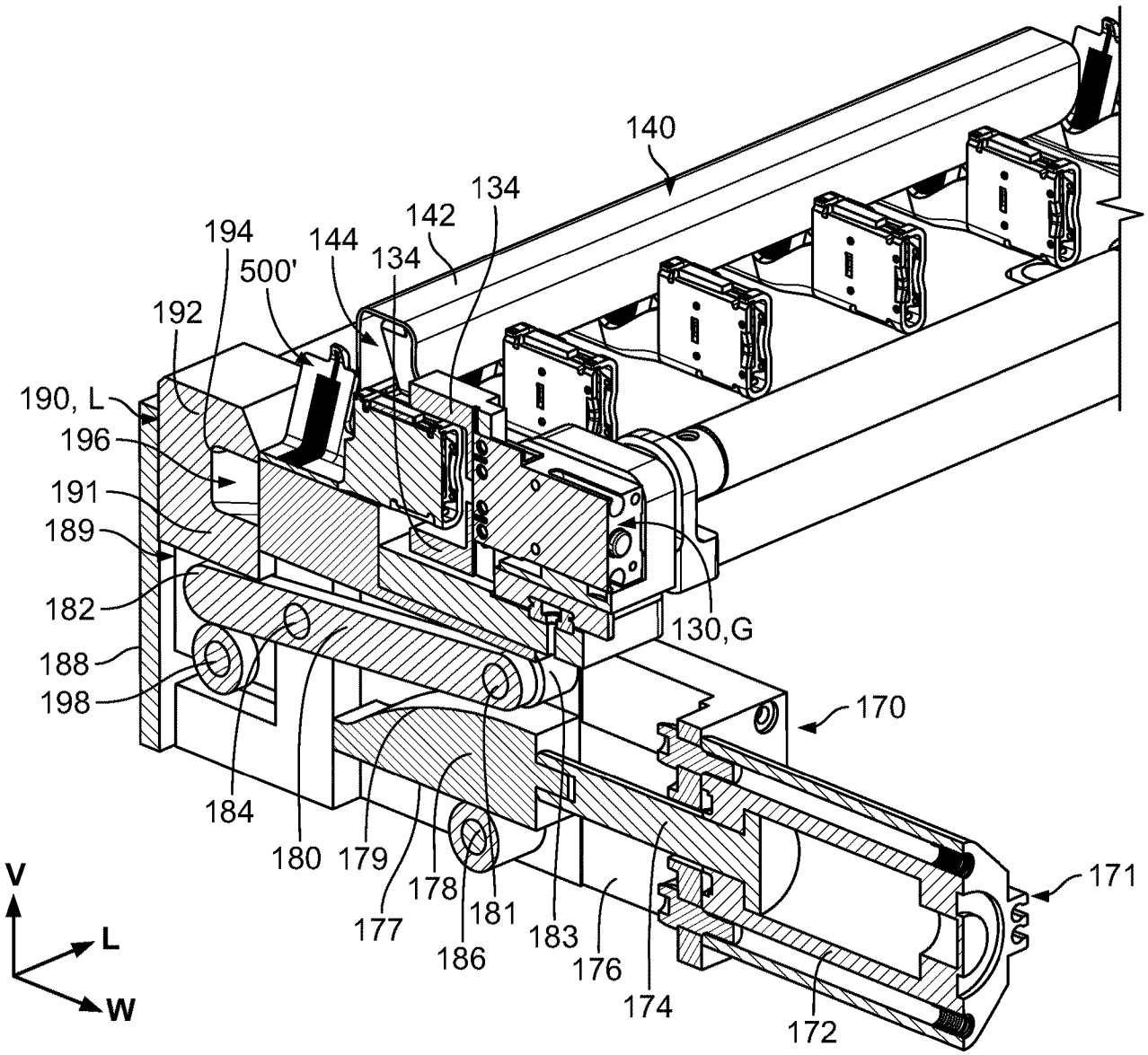
FIG. 8 is a sectional perspective view of the terminal feeding assembly with the shear element in a lower position.

The guide cover 140, shown in FIGS. 2 and 3, has a U-shaped section 142. The U-shaped section 142 can be formed by bending from a flat piece of material, such as a metal sheet, or can be molded into shape. The guide cover 140 is attached to the upper side 112 of the base 110 and the U-shaped section 142 defines a crimp wing passageway 144 with the upper side 112, as shown in FIGS. 5 and 8. In another embodiment, the guide cover 140 can be omitted.

The strip feed assembly 150, as shown in FIGS. 3 and 4, includes a strip drive 152, a pair of guide strips 158 fixed to and extending from the strip drive 152, and a platform 162 movable along the guide strips 158 by the strip drive 152. The strip drive 152 has a strip cylinder 154 and a strip piston 156 disposed within the strip cylinder 154. The platform 162 is attached to an end of the strip piston 156. The strip piston 156 is movable within the strip cylinder 154, for example under control of the controller 400 as described in greater detail below, to move the platform 162 along the guide strips 158 in the longitudinal direction L.

The platform 162 has a post 164 protruding from the platform 162 in the vertical direction V, as shown in FIG. 3. At a protruding end 166 opposite the platform 162, as shown in FIG. 4, the post 164 has an angled face 168 on a side in the longitudinal direction L. The angled face 168 faces toward the strip drive 152 in the longitudinal direction L. The post 164 protrudes from the platform 162 and is spring-loaded to be movable along the vertical direction V with respect to the platform 162 against the spring-loading.

The strip feed assembly 150, as shown in FIG. 2, is attached to the lower side 114 of the base 110 in the feed section 116. The post 164 extends through the feed passageway 117 and, as shown in FIG. 4, the protruding end 166 of the post 164 protrudes beyond the upper side 112 of the base 110 within the feed passageway 117.

The shear assembly 170, as shown in FIGS. 3 and 5, includes a shear drive 171, a shear mount 176, a cam 178 attached to the shear drive 171, a pivot arm 180 movable by the cam 178, a retaining plate 188, and a shear element 190 movable by the pivot arm 180.

The shear drive 171, as shown in FIG. 5, has a shear cylinder 172 and a shear piston 174 disposed within the shear cylinder 172. The shear piston 174 is movable within the shear cylinder 172, for example under control of the controller 400 as described in greater detail below, along a width direction W perpendicular to the longitudinal direction L and the vertical direction V. The shear mount 176, as shown in FIGS. 2 and 5, attaches the shear drive 171 to the shear section 118 of the base 110.

The cam 178, as shown in FIG. 5, is attached to an end of the shear piston 174. The cam 178 has a sloped surface 179 facing away from the shear drive 171 in the width direction W.

The pivot arm 180, as shown in FIG. 5, extends from a first end 181 to an opposite second end 182. The pivot arm 180 has a first roller 183 attached at the first end 181 that is rotatable with respect to the pivot arm 180. The pivot arm 180 has a pivot point 184 between the first end 181 and the second end 182 at which the pivot arm 180 is fixed to the base 110 within the shear section 118 and about which the pivot arm 180 can rotate. The pivot arm 180 is disposed in the shear section 118 between the upper side 112 and the lower side 114.

A second roller 186, shown in FIG. 5, is attached to the base 110 within the shear section 118. The second roller 186 has a fixed translational position with respect to the base 110 and is rotatable with respect to the base 110. The second roller 186 is disposed below and spaced apart from the first roller 183 in the vertical direction V. The cam 178 is positioned between the first roller 183 and the second roller 186 in the vertical direction V, with the sloped surface 179 of the cam 178 abutting the first roller 183 and a flat bottom surface 177 of the cam 178 opposite the sloped surface 179 in the vertical direction V abutting the second roller 186.

The retaining plate 188, as shown in FIGS. 3 and 5, is a flat member attached to the base 110 in the shear section 118. The retaining plate 188 is attached to a side of the base 110 opposite the shear drive 171 in the width direction W. The retaining plate 188 forms a shear element passageway 189 with respect to the base 110 in the shear section 118, shown in FIG. 5.

The shear element 190, as shown in FIG. 5, is disposed in the shear element passageway 189 and is movable in the vertical direction V within the shear element passageway 189. The shear element 190 has a shear base 191 and a cutting arm 192 extending from the shear base 191. The cutting arm 192 has a cutting edge 194 at an end opposite the shear base 191. The shear element 190 has a cutting opening 196 positioned between the cutting arm 192 and the shear base 191 in the vertical direction V.

As shown in FIG. 5, a third roller 198 is attached to the shear element 190 and is rotatable with respect to the shear element 190; the third roller 198 is spaced apart from the shear base 191 in the vertical direction V. The second end 182 of the pivot arm 180 abuts the third roller 198 and is disposed between the third roller 198 and the shear base 191 in the vertical direction V.

The crimping assembly 200, as shown in FIG. 1, includes a lower tooling 210 and an upper tooling 220. The lower tooling 210 has a fixed position and the upper tooling 220 is movable, for example under control of the controller 400 as described in greater detail below, to move toward and away from the lower tooling 210 along the vertical direction V in order to crimp a terminal 500. In an embodiment, the lower tooling 210 and the upper tooling 220 are interchangeable to be used with a plurality of different types of terminals 500. The area between the lower tooling 210 and the upper tooling 220 in which a terminal 500 can be crimped is referred to as a crimping area A, as shown in FIG. 1.

In an embodiment, as shown in FIG. 6, the crimping machine 10 includes a wire positioning device 300 attached to the crimping assembly 200. The wire positioning device 300 includes a wire holder 310 and a wire insertion device 320 attached to and movable with respect to the wire holder 310. The wire holder 310 has a wire passageway 312 in which a wire 350 is held. The wire insertion device 320 grips the wire 350 disposed in the wire passageway 312 and moves the wire 350 along the wire passageway 312; in the width direction W in the shown embodiment. In another embodiment, the wire positioning device 300 can be a robotic arm or any other type of device that can be controlled by a computer to position the wire 350. In another embodiment, as shown in FIG. 1, the wire positioning device 300 can be omitted and the wire 350 can be positioning manually.

Figure 7:
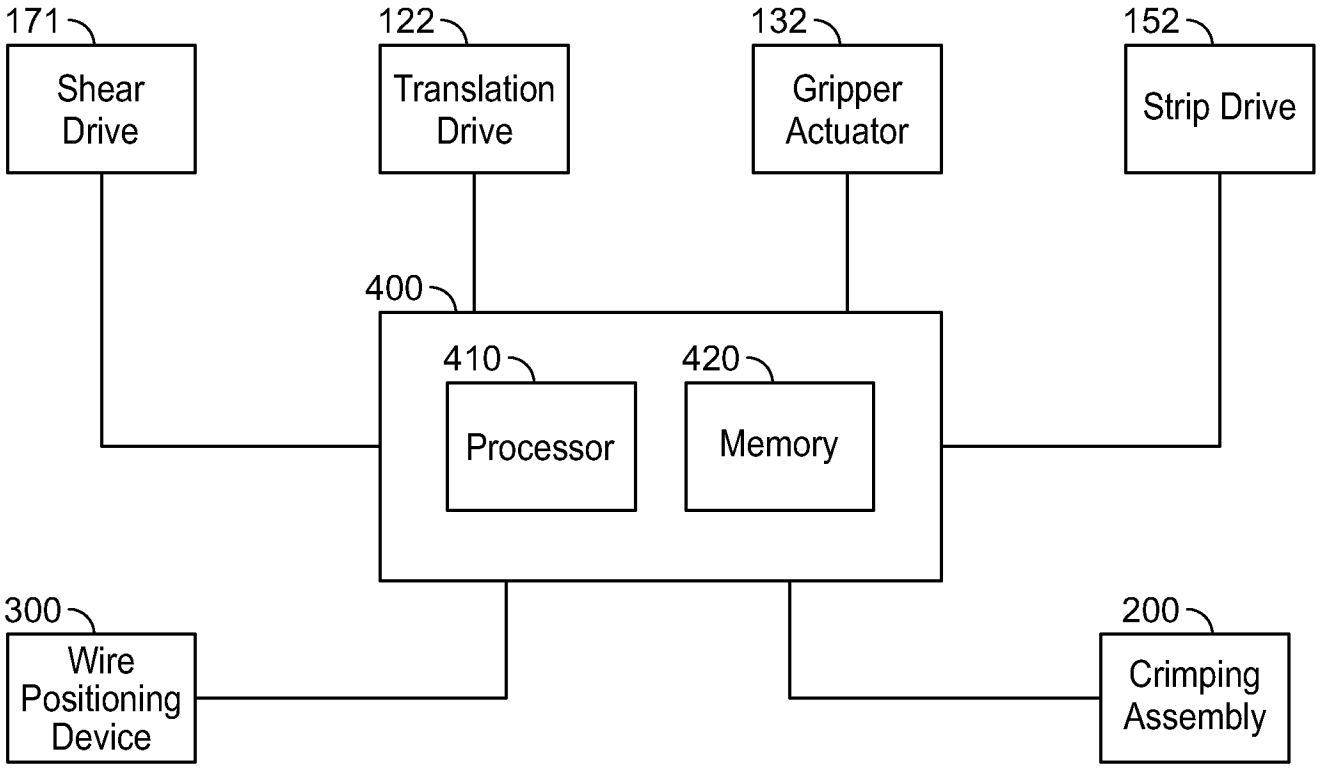
FIG. 7 is a block diagram of a controller and a plurality of elements connected to the controller in the crimping machine.

The controller 400, as shown in FIGS. 1 and 7, includes a processor 410 and a memory 420 connected to the processor 410. The memory 420 is a non-transitory computer readable medium storing instructions thereon that are executable by the processor 410 to perform the control functions of the controller 400 described herein. As shown in FIG. 7, the controller 400 is connected to and capable of controlling the translation drive 122, the gripper actuator 132, the strip drive 152, the shear drive 171, the crimping assembly 200, and the wire positioning device 300 to perform the functions of the crimping machine 10 described in detail below.

The crimp machine 10 shown in FIG. 1 is used to feed a plurality of terminals 500 and crimp each of the terminals 500 to a wire 350. Each of the terminals 500, as shown in FIG. 4, has a pair of crimp wings 510 at a first end and a mating portion 520 at a second end opposite the first end. A connection portion 530, shown in FIG. 4, extends from the pair of crimp wings 510 in the width direction W. In the shown embodiment, the connection portion 530 has a T-shape. The crimp wings 510, the mating portion 520, and the connection portion 530 are only labeled in detail for one of the terminals 500 in FIG. 4 for clarity of the drawings but apply equally to the terminals 500 shown in the embodiments of FIGS. 1-8.

In the embodiment shown in FIGS. 1-8, the plurality of terminals 500 are connected together on a strip 540. As shown in FIG. 4, the connection portion 530 of each of the terminals 500 is connected, for example welded, to the strip 540. The strip 540 extends in the longitudinal direction L and the terminals 500 each extend perpendicularly from the strip 540 in the width direction W; the terminals 500 are spaced evenly apart from each other along the longitudinal direction L. The strip 540 has a plurality of openings 542, with each of the openings 542 positioned between a pair of adjacent terminals 500 in the longitudinal direction L. Only some of the openings 542 in the strip 540 are labeled in FIG. 4 for clarity of the drawings. The strip 540 is also shown without one portion in FIG. 4 for clarity of other elements, but is a continuous piece as shown in FIG. 3.

The use of the crimping machine 10 to feed the terminals 500 and crimp the terminals 500 to the wires 350 will now be described in greater detail primarily with reference to FIGS. 1, 5, 6, and 8.

As shown in FIGS. 1 and 2, the terminals 500 on the strip 540 are inserted into the terminal feeding assembly 100 in the longitudinal direction L. In an embodiment having the guide cover 140, the crimp wings 510 of the terminals 500 are positioned in the crimp wing passageway 144, as shown in FIG. 5.

The strip 540 slides over the feed passageway 117 shown in FIG. 4 as the terminals 500 are inserted into the terminal feeding assembly 100. The strip 540 depresses the post 164 protruding into the feed passageway 117 as the strip 540 slides in by pressing on the angled face 168 of the post 164 against the spring loading of the post 164. The terminals 500 are inserted into the terminal feeding assembly 100 until the protruding end 166 of the post 164 engages one of the openings 542 in the strip 540, as shown in FIG. 4.

The controller 400 controls the strip drive 152 to move the strip piston 156 with respect to the strip cylinder 154, moving the platform 162 with the post 164 away from the strip drive 152 along the guide strips 158. By engagement of the protruding end 166 with the opening 542 in the strip 540, the movement of the post 164 with the platform 162 moves the strip 540 and the terminals 500 along the longitudinal direction L with respect to the base 110. The controller 400 controls the strip drive 152 to move the platform 162 along the longitudinal direction L until an end terminal 500' in the longitudinal direction L is aligned with the terminal gripper 130, as shown in FIGS. 2 and 4. The strip feed assembly 150 feeds the terminals 500 on the strip 540 to the translation device 120 and the shear assembly 170. The end terminal 500' is identical to the other terminals 500 but is denoted with the reference number 500' merely to identify which terminal 500 is being referenced for ease of understanding.

The translation device 120, as shown in FIGS. 1 and 2, begins with the translation drive 122 in the retracted position P1. The translation drive 122 in the retracted position P1 positions the terminal gripper 130 in a gripping position G, which is outside of the crimping area A. When the strip drive 152 has moved the end terminal 500' into alignment with the terminal gripper 130 in the gripping position G, the controller 400 controls the gripper actuator 132 to move the arms 134 toward one another in the vertical direction V, gripping the mating portion 520 of the terminal 500' as shown in FIGS. 2 and 5. The end terminal 500' remains attached to the strip 540 when the end terminal 500' is initially gripped by the terminal gripper 130 in the gripping position G.

Once the arms 134 of the terminal gripper 130 have gripped the terminal 500', the controller 400 controls the shear assembly 170 to separate the terminal 500' from the strip 540. As shown in FIG. 5, when the terminal gripper 130 initially grips the terminal 500', the shear element 190 is in an upper position U and the strip 540 and the connection portion 530 of the terminal 500' are positioned in the cutting opening 196. The controller 400 then controls the shear drive 171 to move the shear piston 174 out of the shear cylinder 172 along the width direction W, moving the cam 178 along the width direction W toward the shear element 190.

As the cam 178 moves along the width direction W, as shown in FIGS. 5 and 8, the flat bottom surface 177 of the cam 178 rolls along the second roller 186 and first roller 183 rolls along the sloped surface 179 of the cam 178. As shown in FIG. 8, movement of the first roller 183 along the sloped surface 179 drives the first end 181 of the pivot arm 180 to rotate upward the vertical direction V about the pivot point 184. The second end 182 of the pivot arm 180 then rotates downward while rolling on the third roller 198 and remaining positioned between the third roller 198 and the shear base 191 in the vertical direction V.

As shown in FIG. 8, downward rotation of the second end 182 of the pivot arm 180 moves the shear element 190 downward in the vertical direction V in the shear element passageway 189 to a lower position L. The downward motion of the shear element 190 moves the cutting edge 194 through the strip 540 and the connection element 530 in the vertical direction V, separating the terminal 500' from the strip 540 while the terminal gripper 130 grips the terminal 500'.

Once the terminal 500' is separated from the strip 540, the controller 400 controls the translation drive 122 to move the translation piston 126 out of the translation cylinder 124, moving along the longitudinal direction L from the retracted position P1 to the extended position P2 shown in FIG. 6. The terminal gripper 130 gripping the terminal 500' separated from the other terminals 500 and the strip 540 moves to a crimping position C when the translation drive 122 is in the extended position P2, positioning the terminal 500' in the crimping area A between the lower tooling 210 and the upper tooling 220.

With the terminal 500' held in the crimping area A by the terminal gripper 130 in the crimping position C, as shown in FIG. 6, the controller 400 controls the wire positioning device 300 to position a conductor 352 of the wire 350 in the crimping area A, between the crimp wings 510 of the terminal 500'. In another embodiment, a user can manually position the conductor 352 of the wire 350 between the crimp wings 510 in the crimping area A. The controller 400 controls the crimping assembly 300 to move the upper tooling 220 toward the lower tooling 210 with the conductor 352 positioned between the crimp wings 510, crimping the crimp wings 510 around the conductor 352 and terminating the wire 350.

Once the terminal 500' is crimped to the wire 350, the controller 400 controls the gripper actuator 132 to move the arms 134 away from each other, releasing the grip on the terminal 500'. The controller 400 then controls the translation drive 122 to move back to the retracted position P1 shown, for example, in FIG. 2. The controller 400 then controls the strip feed assembly 150 to retract the strip piston 156 into the strip cylinder 154, moving the platform 162 back toward the strip cylinder 154 along the longitudinal direction L until the protruding end 166 of the post 164 engages another opening 542 of the strip 540. The controller 400 then controls the strip drive 152 to again move the platform 162 with the post 164 away from the strip drive 152 and back in the longitudinal direction L along the guide strips 158, until a new end terminal 500' connected to the strip 540 is aligned with the terminal gripper 130, as shown in FIGS. 2 and 4 and described above. The controller 400 then repeats the gripping, shearing, moving, and crimping processes described above for the new end terminal 500', and can loop through the above-described process as long as a terminal 500 connected to a strip 540 is loaded into the terminal feeding assembly 100.

Figure 9:
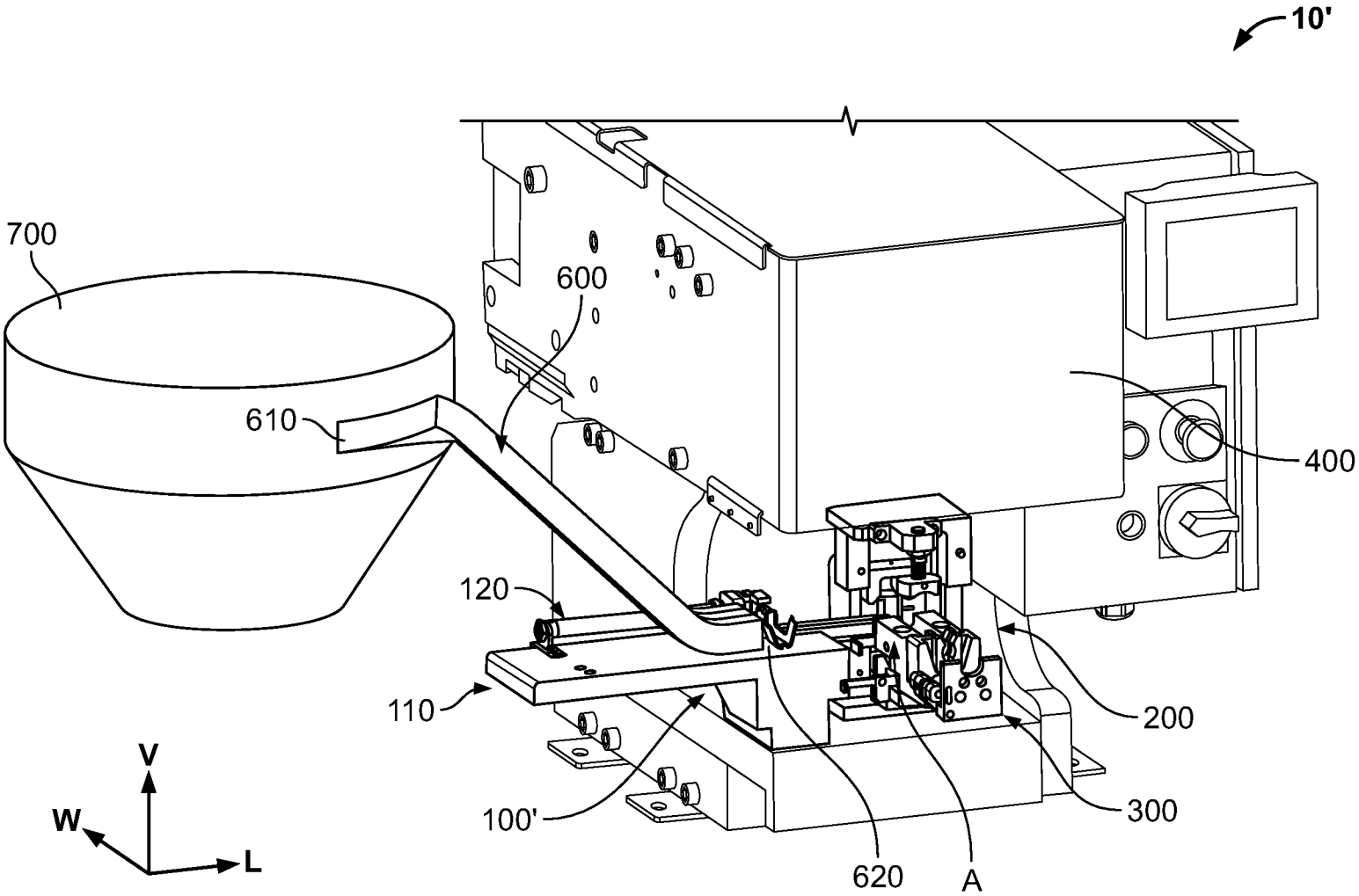
FIG. 9 is a perspective view of a crimping machine according to another embodiment.

A crimping machine 10' according to another embodiment is shown in FIG. 9. Like reference numbers refer to like elements, and primarily the differences from the embodiment of the crimping machine 10 shown in FIG. 1 will be described in detail herein.

The crimping machine 10', as shown in FIG. 9, comprises a terminal feeding assembly 100' according to another embodiment, the crimping assembly 200 connected to the terminal feeding assembly 100', and the controller 400 connected to and controlling the terminal feeding assembly 100' and the crimping assembly 200. In another embodiment, the crimping machine 10' can include the wire positioning device 300 described above.

Figure 10:
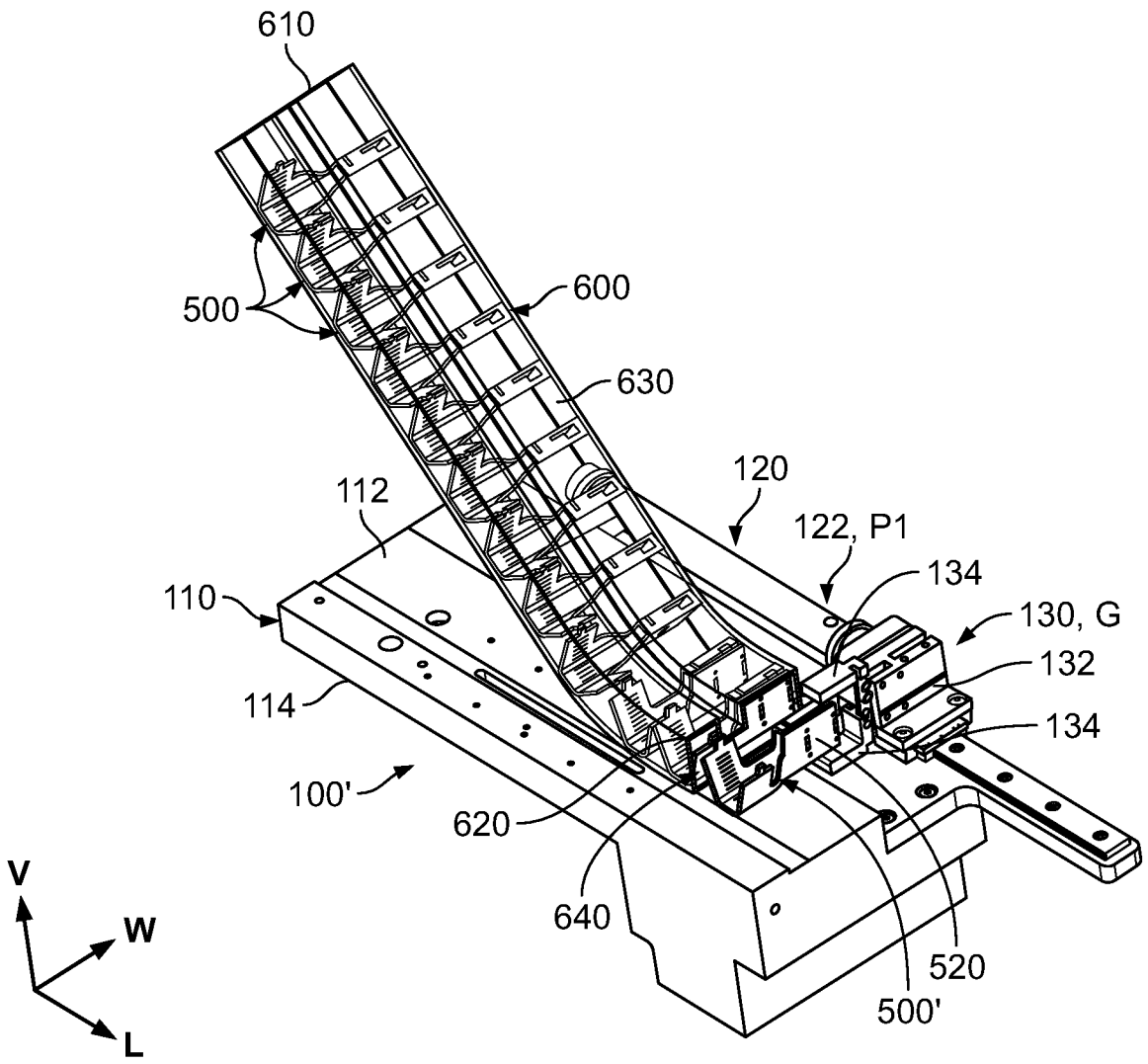
FIG. 10 is a perspective view of a terminal feeding assembly of the crimping machine of FIG. 9.

The terminal feeding assembly 100', as shown in FIGS. 9 and 10, includes the base 110, the translation device 120 disposed on the base 110, and a terminal magazine 600 connected to the base 110. In the embodiment shown in FIGS. 9 and 10, the terminal magazine 600 replaces the guide cover 140, the strip feed assembly 150, and the shear assembly 170.

As shown in FIG. 10, the terminal magazine 600 has a first end 610, a second end 620 opposite to the first end 610, and an angled portion 630 between the first end 610 and the second end 620. The terminal magazine 600 defines a terminal passageway 640 extending through the terminal magazine 600 from the first end 610 to the second end 620 through the angled portion 630. The angled portion 630 extends diagonally in a plane defined by the vertical direction V and the longitudinal direction L. The second end 620, as shown in FIG. 10, is attached to the upper side 112 of the base 110 and is aligned with the terminal gripper 130 when the translation drive 122 is in the retracted position P1.

In the crimping machine 10', the terminals 500 are not attached to the strip 540 but are instead loaded loose into the first end 610 of the terminal magazine 600. The terminals 500 may be loaded manually into the first end 610 of the terminal magazine 600. In another embodiment, as shown in FIG. 9, the crimping machine 10' includes a piece feeder 700 connected to the first end 610. In the embodiment including the piece feeder 700, the loose terminals 500 are loaded into the piece feeder 700, which feed the terminals 500 individually into the first end 610. The piece feeder 700 may be a drum feeder controlled by the controller 400, or may be any other type of controllable feeding device capable of individually feeding terminals 500 into the first end 610.

The terminals 500 disposed in the terminal magazine 600 separate from one another travel in the terminal passageway 640 down the angled portion 630 to the second end 620, filling the terminal passageway 640 depending on the number of terminals 500 loaded into the terminal magazine 600. The end terminal 500' at the second end 620, as shown in FIG. 10, is positioned in alignment with the terminal gripper 130 in the width direction W when the terminal gripper 130 is in the gripping position G.

The crimping machine 10' then works similarly to the crimping machine 10 described with respect to the embodiment of FIGS. 1-8 above, with the controller 400 controlling the gripper actuator 132 to grip the mating portion 520 of the end terminal 500' and controlling the translation drive 122 to move to the extended position P2, moving the terminal gripper 130 into the crimping position C in the crimping area A shown in FIG. 9. The controller 400 can then control the wire positioning device 300 and the crimping assembly 200 to crimp the terminal 500' to the wire 350 prior to controlling the terminal gripper 130 to release the crimped terminal 500'. The controller 400, as similarly described in the crimping machine 10, then controls the translation drive 122 to move back to the retracted position P1 shown in FIG. 10, and is prepared to grip a new end terminal 500' fed along the terminal magazine 600 to repeat the moving and crimping processes for the new end terminal 500'. The crimping machine 10', under control of the controller 400, can loop through the above-described process as long as a terminal 500 is loaded into the terminal magazine 600.

The crimping machine 10 according to the embodiment of FIGS. 1-8 allows an operator to load the terminals 500 connected to the strip 540 into the terminal feeding assembly 100. The terminal feeding assembly 100, under control of the controller 400, then performs the functions of separating the terminals 500 from the strip 540 and feeding the terminals 500 individually to the crimping area A for crimping to the wire 350. The separation and feeding performed by the terminal feeding assembly 100 avoids the need for an operator to manually and individually place the terminals 500 in the crimping area A, requiring significantly less of the operator's time to crimp the terminals 500 to the wires 350, decreasing an overall time required to crimp the terminals 500 to the wires 350, and lessening the risk of operator injury. The crimping machine 10' of the embodiment of FIGS. 9 and 10 likewise improves efficiency in feeding and crimping terminals 500 that are not connected to the strip 540 by allowing the operator to simultaneously load the plurality of terminals 500 into either the terminal magazine 600 or the piece feeder 700, instead of manually and individually placing the terminals 500 in the crimping area A.

What is claimed is:

1. A terminal feeding assembly, comprising:

a translation device having a guide track, a terminal gripper movable along the guide track, and a translation drive connected to the terminal gripper, the translation drive moves the terminal gripper along the guide track from a gripping position outside of a crimping area of a crimping assembly to a crimping position in the crimping area while the terminal gripper grips a terminal, the terminal is one of a plurality of terminals fed to the translation device, the terminal gripper grips one of the plurality of terminals separate from a remainder of the plurality of terminals while moving along the guide track, the plurality of terminals are connected by a strip; and a shear assembly separating the one of the plurality of terminals from the strip while the terminal gripper grips the one of the plurality of terminals, the shear assembly includes a shear element, a shear drive, and a cam actuated by the shear drive to move the shear element between an upper position and a lower position.

2. The terminal feeding assembly of claim 1, wherein the translation drive includes a translation cylinder and a translation piston disposed in the translation cylinder, the translation piston is connected to the terminal gripper.

3. The terminal feeding assembly of claim 2, wherein the translation drive is movable between a retracted position and an extended position, the movement between the retracted position and the extended position moves the terminal gripper between the gripping position and the crimping position.

4. The terminal feeding assembly of claim 1, wherein the terminal gripper includes a gripper actuator and a pair of arms, the pair of arms are connected to the gripper actuator and movable by the gripper actuator toward and away from each other to grip the terminal.

5. The terminal feeding assembly of claim 4, wherein the pair of arms is one of a plurality of interchangeable pairs of arms each connectable to the gripper actuator and each corresponding to one of a plurality of different types of the terminal.

6. The terminal feeding assembly of claim 1, wherein the shear element has a shear base, a cutting arm extending from the shear base, and a cutting opening positioned between the cutting arm and the shear base.

7. The terminal feeding assembly of claim 6, wherein the strip is positioned in the cutting opening in the upper position of the shear element and the one of the plurality of terminals is removed from the strip in the lower position of the shear element.

8. The terminal feeding assembly of claim 1, wherein the cam rotates a pivot arm to move the shear element between the upper position and the lower position.

9. The terminal feeding assembly of claim 1, further comprising a strip feed assembly feeding the plurality of terminals connected by the strip to the shear assembly.

10. The terminal feeding assembly of claim 9, wherein the strip feed assembly includes a post engaging one of a plurality of openings in the strip.

11. The terminal feeding assembly of claim 10, wherein the strip feed assembly includes a strip drive connected to the post and a pair of guide strips, the strip drive moves the post along the guide strips while the post engages one of the openings in the strip to move the strip.

12. The terminal feeding assembly of claim 1, further comprising a base, the translation device is attached to the base and the shear assembly is disposed in a shear section of the base.

13. The terminal feeding assembly of claim 12, wherein the base has a guide cover attached to an upper side of the base and defining a crimp wing passageway with the upper side, a plurality of crimp wings of the plurality of terminals are guided along the crimp wing passageway.

14. The terminal feeding assembly of claim 1, further comprising a terminal magazine, the plurality of terminals are disposed in the terminal magazine separate from one another and are fed to the translation device along the terminal magazine.

15. A terminal feeding assembly, comprising:

a translation device having a guide track, a terminal gripper movable along the guide track, and a translation drive connected to the terminal gripper, the translation drive moves the terminal gripper along the guide track from a gripping position outside of a crimping area of a crimping assembly to a crimping position in the crimping area while the terminal gripper grips a terminal, the terminal is one of a plurality of terminals fed to the translation device, the terminal gripper grips one of the plurality of terminals separate from a remainder of the plurality of terminals while moving along the guide track, the plurality of terminals are connected by a strip;

a shear assembly separating the one of the plurality of terminals from the strip while the terminal gripper grips the one of the plurality of terminals; and a strip feed assembly feeding the plurality of terminals connected by the strip to the shear assembly, the strip feed assembly includes a post engaging one of a plurality of openings in the strip.

16. The terminal feeding assembly of claim 15, wherein the strip feed assembly includes a strip drive connected to the post and a pair of guide strips, the strip drive moves the post along the guide strips while the post engages one of the openings in the strip to move the strip.

17. A terminal feeding assembly, comprising:

a translation device having a guide track, a terminal gripper movable along the guide track, and a translation drive connected to the terminal gripper, the translation drive moves the terminal gripper along the guide track from a gripping position outside of a crimping area of a crimping assembly to a crimping position in the crimping area while the terminal gripper grips a terminal, the terminal is one of a plurality of terminals fed to the translation device, the terminal gripper grips one of the plurality of terminals separate from a remainder of the plurality of terminals while moving along the guide track, the plurality of terminals are connected by a strip;

a shear assembly separating the one of the plurality of terminals from the strip while the terminal gripper grips the one of the plurality of terminals; and a base, the translation device is attached to the base and the shear assembly is disposed in a shear section of the base, the base has a guide cover attached to an upper side of the base and defining a crimp wing passageway with the upper side, a plurality of crimp wings of the plurality of terminals are guided along the crimp wing passageway.

* * * * *